United States Patent [19]

Beal

[11] 4,052,072

[45] Oct. 4, 1977

[54] EDUCATIONAL WORLD MAP GAME

[76] Inventor: Philip E. Beal, 43 Merrill St., Portland, Maine 04101

[21] Appl. No.: 660,485

[22] Filed: Feb. 23, 1976

[51] Int. Cl.[2] ..... A63F 3/04

[52] U.S. Cl. ..... 273/134 AC; 273/134 B; 273/134 C; 273/134 G; 273/137 R; 273/157 R

[58] Field of Search ..... 273/134

[56] References Cited

U.S. PATENT DOCUMENTS

| | | | |
|---|---|---|---|
| 2,479,747 | 8/1949 | Lachance | 273/134 AC |
| 3,368,816 | 2/1968 | Milazzo et al. | 273/134 AC |
| 3,698,718 | 10/1972 | Kuhn | 273/134 B |

FOREIGN PATENT DOCUMENTS

| | | | |
|---|---|---|---|
| 421,176 | 5/1947 | Italy | 273/134 AT |
| 709,543 | 5/1954 | United Kingdom | 273/134 AT |

*Primary Examiner*—Delbert B. Lowe
*Attorney, Agent, or Firm*—Laforest S. Saulsbury

[57] ABSTRACT

An educational world map game adapted to be played on a pachisi-like game playing board bearing the world continental areas with countries marked off and lines of playing spaces to be traversed by playing pieces counted off in number according to the roll of dice and directed by a drawing of a card or playing piece showing the country shape in one of the continental areas. With the playing pieces being shaped as puzzle parts and each having the puzzle outline of a country, they are adapted to fit with one another and to overlie the country spaces marked off in the continental areas at the terminal ends of inwardly-extending lines of the playing spaces and these country spaces may be counted in continuation of the line space the shortest distance within the continental area to reach final country destination. The lines of spaces are arranged to provide one closed peripheral line about the board with a starting point therein and lines of playing spaces extending inwardly from the closed peripheral line at points therealong that respectively terminate in the respective continental areas. The playing piece is advanced along the lines of playing spaces and into continental areas according to the rolling of dice by the players. The game is completed with all of the countries provided for the continental areas being placed therein and the winner will be the player who has located the greater number of countries in the continental areas or scored the most points according to variations of the game.

5 Claims, 6 Drawing Figures

Fig. 1a
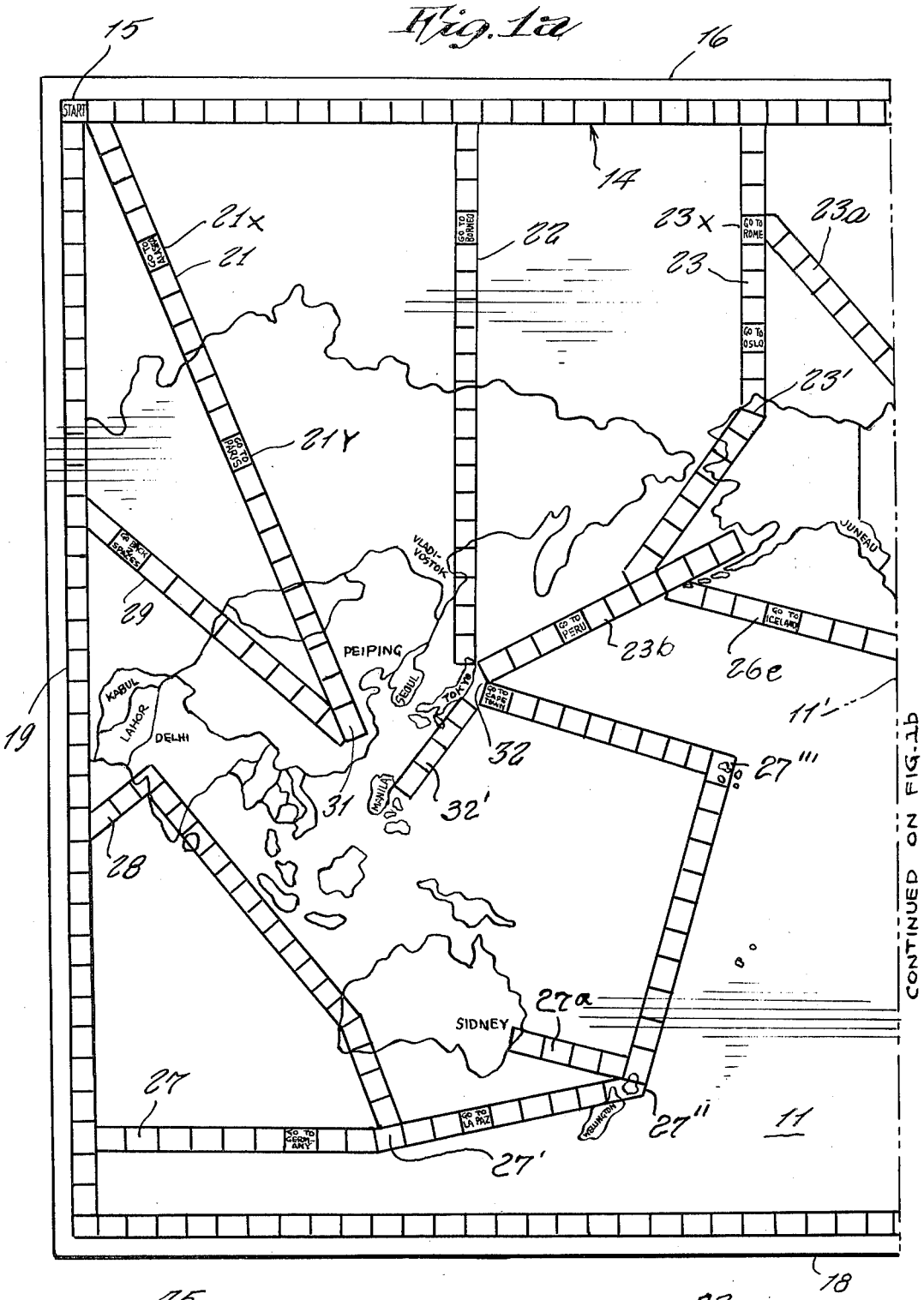
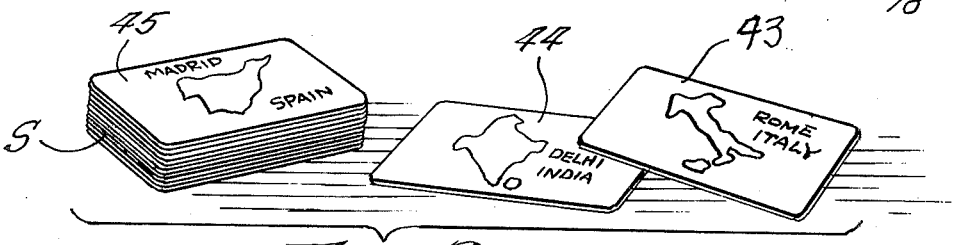
Fig. 2

Fig. 4
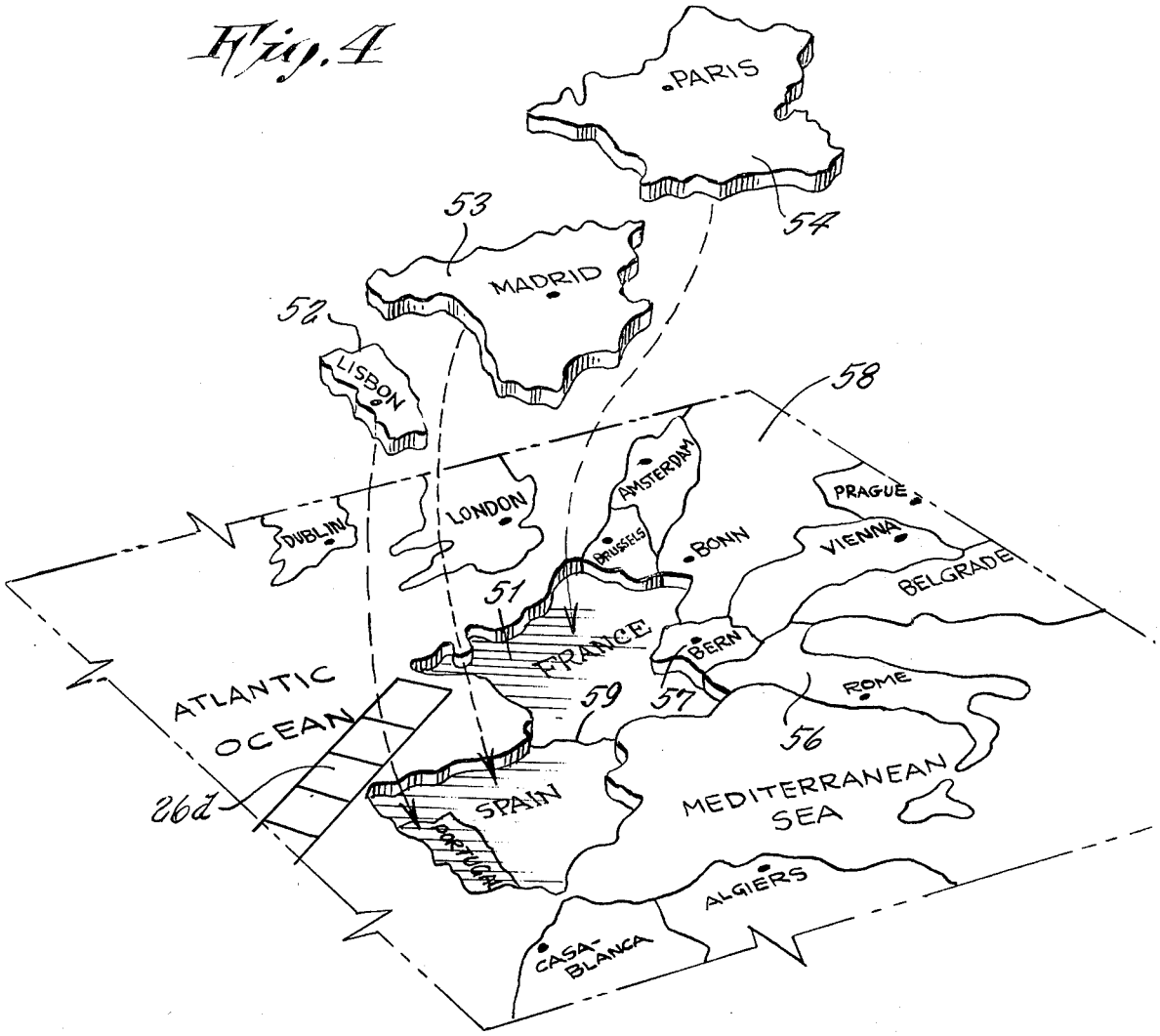
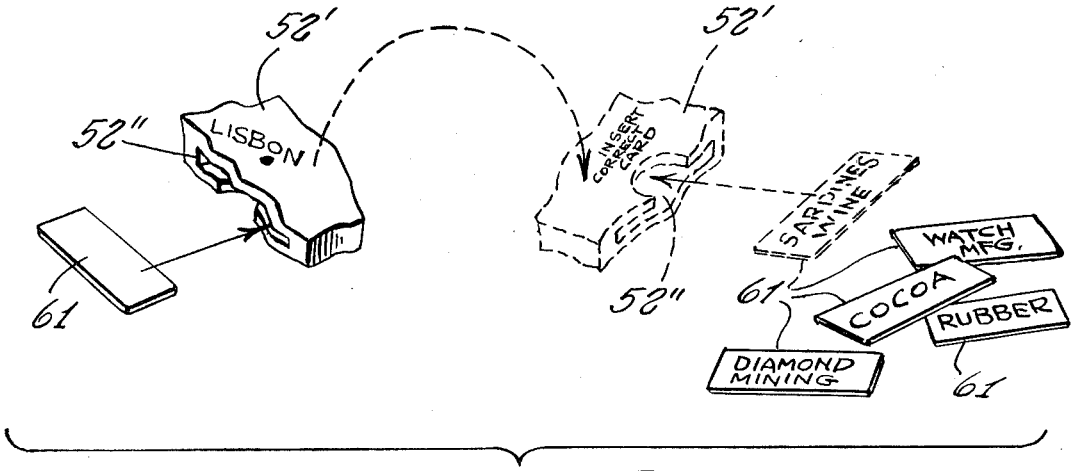
Fig. 5

EDUCATIONAL WORLD MAP GAME

This invention relates to an educational world map game and more particularly to a novel combined pachisi and puzzle game.

It is the principal object of this invention to provide an educational world map game from which one may learn the countries around the world, their capital cities and the principal products or raw materials for which the countries are noted, and one that can be played by both children and adults to enhance their knowledge of the world.

It is another object of the invention to provide a pachisi-like board game played with dice and movable playing pieces wherein a closed line of playing spaces extends fully about the periphery of the game board and has the starting point for the playing pieces therein at one corner of the board or any location therealong, the color of the playing piece for one player being different than the color of the pieces for the other player, and a plurality of lines of playing spaces that extend from points along the closed line of peripheral spaces and that are directed inwardly thereof to locations sought by the player to reach with his playing piece in order to score a point, and wherein the inwardly-extending lines of spaces have detour or penalty spaces indicating loss of spaces or ordering the player to take his playing piece to some more distant location than the designated location for which he had started and often he has to back up or proceed thereto through a more roundabout route, and wherein certain of the inward lines of spaces may intersect one another to permit the advance of the playing pieces therealong by a choice of one line or the other.

It is another object of the invention to provide a world map board game in which the continental land areas of the map are outlined or depressed to receive puzzle shaped playing pieces and mark the shape of the countries within continental areas, so that the playing pieces themselves have to be fitted in puzzle-fashion into the outlined and marked country areas designated therefor. With the filling of all of the continental areas, the game is completed and the score ascertained by the player for points and number of countries he has placed upon the board.

It is a further object of the invention to provide country-shaped puzzle pieces for a map board game that are respectively provided with a pocket in which a removable card can be placed that will name certain of the outstanding raw materials and products of the country outlined by the puzzle piece, this card being kept in the pocket until the playing piece has reached its location, when the player will attempt to name the goods on the card, and the card will be pulled by the player, and if he has named the raw materials and products as given on the card he may be given an additional scoring point.

Other objects of the invention are to provide a combined pachisi and map board puzzle game, having the above objects in mind, which is of much educational value, simple in construction, interesting to play, compact, has minimum playing parts, is of pleasing appearance, can be played by both children and adults, and with either a small or a large number of players.

For a better understanding of the invention, reference may be had to the following detailed description taken in connection with the accompanying drawing, in which:

FIGS. 1*a* and 1*b*, when taken together, are a plan view of the full world map gameboard having the outline of the map of the world by the continents with their countries identified by their outlines therein and showing a line of playing spaces closed peripherally around the edge of the board, inwardly-extending lines of spaces from the closed peripheral line at points therealong and some of them intersecting or crossing one another and these inward ones terminating respectively within the respective continental areas.

FIG. 2 is a collective perspective view of a stack of drawing cards showing outlines of the various countries of the world, their names, with their capital names thereon, and two of such cards being shown separated from the stack and overlying one another.

Figure 3:
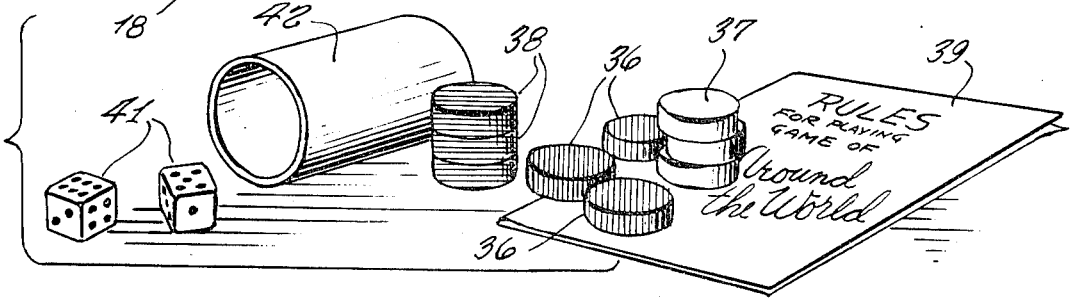
FIG. 3 is also a collective perspective view of playing dice, a shaking cup therefor, rules of the game entitled "Around the World" and three different colored sets of typical playing discs, one set for each player, that are moved along the line of spaces according to rolled dice and in pachisi fashion.

FIG. 4 is an enlarged collective perspective view of a fragment of the world map modified to depress the continental areas and defining the several countries thereof so that puzzle pieces are fitted flush with the board surface and within the continental areas, and wherein the puzzle pieces themselves can become the playing pieces thereby eliminating the need for the cards of FIG. 2 and the playing disc pieces of FIG. 3, the view showing only the European continent area and the countries thereof with three different country pieces raised above the map and arrows directed toward their positions within the depressed puzzle area.

FIG. 5 is a collective perspective view of a solitary country puzzle piece, such as that of Portugal, and modified to provide a side edge pocket therein to contain a card listing the basic raw materials and/or products of the country.

Figure 1B:
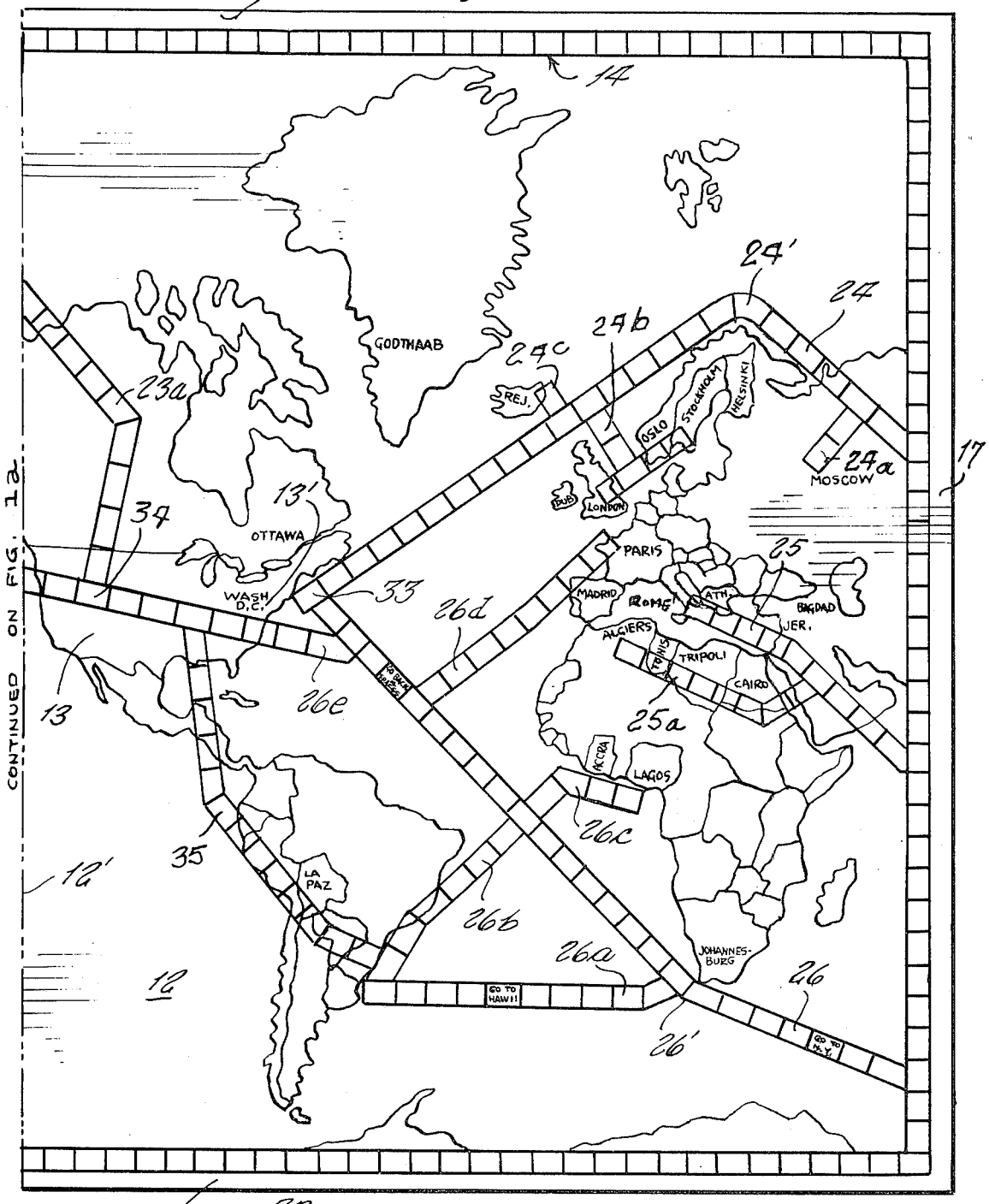

Referring now particularly to FIGS. 1*a*, 1*b*, 2 and 3, it should be seen the map board is made of halves 11 and 12 of FIGS. 1*a* and 1*b* that are intended to be joined along inner dot and dash lines 11' and 12' to provide a complete map of the world including the continents of Asia, Europe, North and South America, and Africa, as well as large island areas of Australia and Greenland and several smaller island areas such as England, Ireland, Cuba and Northern Canada. All of the areas may be named on the map but that may take something away from the game so it has been thought sufficient merely to show their outlines, those of the continents and the countries within them, for example, North America as determined from its shape and with the United States being shown at 13, therewithin. There are shown in certain countries the names of the capital cities so as to teach the player the capitals of countries as well as their shapes, and as later seen provide a way to teach the country's principal raw materials and products. While only the names of some of the capital cities are placed on the map for some of the countries, it should be understood that the capitals of other countries and other data may be included with space permitting. One such capital, Washington, D.C., of the United States, is indicated by legend 13' in FIG. 1*b*.

With the board halves of FIGS. 1a and 1b joined together a continuous or closed line 14 of playing spaces extends completely around the periphery of the map board and outside of all the world and continental areas of the map. This line of spaces is closed and runs from a starting point space indicated at 15 at the upper left hand corner of the joined map board, along the top side 16, down the right side 17, along the bottom edge 18 and up the left side 19 to the left corner starting point space 15. Starting from the closed peripheral line 14 of spaces at different locations along the sides of the board and running inwardly over the map following somewhat the air flight routes and sea ship lanes of the world from the spaces of the closed peripheral line 14 along the upper edge 16 and extending inwardly are lines 21, 22 and 23 of spaces and from right edge 17 are inwardly extending lines 24, 25 and 26 of spaces. No lines of spaces extend inwardly from the closed peripheral line along bottom edge 18. Then at the left side 19 lines 27, 28 and 29 of spaces extend inwardly from the closed line of spaces on the left edge 19. Some of the inwardly extending lines are straight, as for example lines 21, 22 and 29, and all of them pass directly to and terminate at strategic locations on the map, as in China and Japan where there are the masses of people of Asia. The lines 23, 24, 25, 26, 27 and 28 of spaces are not straight but angle or change in direction, one such line being line 23 angled at 23' and having branches 23a and 23b that intersect with branches of other lines; for instance line 23 has a branch **23*a* that intersects a branch 26*e* of line 26 from the right edge 17 as does the branch 23*b*. This line 26 that has an angle bend 26' has the several branches indicated at 26*a*, 26*b*, 26*c*, 26*d* and 26*e*. The lines 21 and 29 of spaces from the left side intersect at 31, while the lines 22, 23 and 27 terminate in Japan at 32. A short line 32' runs between Japan and the Philippines. Bent lines 24 and 26 from the right join at 33 at the United States and lines 23 and 26 join at 34 and lines 27 and 28 join at 27'. Line 27 has a bend 27'' over New Zealand with a branch 27a leading therefrom to Australia. The line 27 continues on from New Zealand to Hawaii where it takes a sharp bend 27''' to terminate at 32 on Japan. The line 24 has a bend 24' and branches 24*a*, 24*b* and 24*c* that respectively go to Moscow, England and Iceland before terminating at 33 in the Unites States. Line 25 leads to the Middle East and Europe and has a branch 25*a* to Northern Africa. Line 26 leads to South Africa with branches 26*c* and 26*d* leading respectively to Central Africa and Europe. Branches 26*a* and 26*b* lead to South America. A line 35 joins the branches 26*b* and 26*e*, with the branch 26*e*** continuing across the United States and to Alaska. The several continents are clearly outlined and should be recognizable by their shape. There is at least one line with spaces or branches thereof terminating in each continental area where the designated country is to be found.

A player will be given a set of three discs or wafer-like playing pieces 36, 37 or 38 of a selected color such as red, white or blue, as shown in FIG. 3, and proceed with the game according to in book rules 39 and that can vary more or less in detail but in general will conform in a manner to be now set forth. Each player after selecting a set of three playing discs will place one of them in the starting space 15 at the upper left hand corner of the board. The first player rolls dice 41 from a dice cup 42 and adds the top showings of the two dice, as for instance the "eleven" as shown in FIG. 3. Prior to making any movement of the playing piece 36, 37 or 38, along the line of spaces, the player takes the top card from a stack S, such as a card 43 that bears the map of Italy. He will place such card in front of him, locate Italy on the map, and make some mental determination as to on which lines of spaces he will move his playing disc piece. Once he has made this determination he will count off eleven spaces as determined from the dice in the direction of the European continent wherein Italy lies. He would probably proceed along top spaces 14 of the top edge 16 of the board and then inwardly down line 23, branch off at **23*a*, join branch 26*e* of line 26, that has led inwardly from right edge 17, move outwardly on line 26, then outwardly on its branch 26*d* that terminates in Europe and count off the country spaces until finally in Italy where the capital name will be found. Record is marked down of this scoring or the card 43 can be put in a pile to assist in the scoring. Of course, the player must roll the dice several times, in turn with other players, and in pachisi fashion land on spaces that may tell the player to place his disc at another location either as a bonus or penalty, that would either keep him on the selected path or off from it so that he might have to detour or even play his way back through the starting position 15. It should be noted that if he could land by count on space 23x of line 23 that says "Go to Rome" he would go there promptly without having to count off further and the card 43** would be placed in his winning stack of cards at his playing station.

Of course, other players will have the other colored sets of playing pieces 37 and 38 and will be playing in turn with this first player. The other players also start by placing one of their playing pieces on the starting position 15 in the upper left hand corner of the board. The second player will roll the dice 41 from the cup 42 and whatever number comes up from the dice he will move along that number of spaces. He will have picked up card 44 from the stack S and as seen from FIG. 2 that card bears the outline and the name of "India" and its capital city "Delhi." This second player would probably best proceed down spaces 14 along the left edge 19 and inward along line 28 for three spaces to hit India. The capital is "Delhi" and if the name of the capital had been left off the card, the player would have learned the name from the map. No obstacle spaces would have hindered his playing.

The third player gets the colored set of playing pieces that is left and places one of the pieces upon the starting space 15 and draws from the card stack S card 45 which bears the map of "Spain" and names the capital city as "Madrid." This third player will roll the dice 41 from cup 42 and proceed along the spaces as the other players have done but toward Spain. It would seem best that the player with the red disc pieces start first, the white disc pieces 37 second and third the blue pieces 38. Thus, the players would take their turns in Red, White and Blue fashion. As soon as the player uses one piece from the starting point 15, he should replace it with another one of his three pieces. Each player will start only three discs at a time upon the spaces, but as soon as he has scored he can start again with the scoring disc, and thereby permit one player to have at most three discs at a time upon the board.

The third player with the card for Spain would likely proceed in the same manner as the first player proceeded to Italy, that is, by the use of the closed peripheral space line 14 along the top edge 16 to the inward line of spaces 23 and then to its branch 23a. Numerous line blocks are seen along the inwardly-extending lines, for instance, in line 21 of spaces starting almost directly from the starting point 15 are two legended obstacle spaces **21*x* and 21*y*** that respectively direct the player to "go to Alaska" or to "go to Paris" that would put the player completely off the beaten path to Asia and China and require a return from the obstacle legended countries, if not lucky, through another and more distant route. Other obstacle spaces may not seem so difficult but nevertheless they have to be undertaken. Double landing on a single space with oneself or another may be prohibited and could send a player at least back to the closed peripheral line of spaces. But with three playing pieces of each player at a time this more often could be avoided. Each player can have all three of his playing pieces on the board at the same time and with three country cards that he has chosen lying face up on the table before him. The game can continue until all the cards of the stack S have run out and been located in their proper country locations. When once a player has received half the number of cards of the stack S in his score file with adequate other points he will have won the game. Of course, two can play the game and with additional sets of playing pieces more than three can play the game.

In the modification of the game as shown in FIG. 4, the map playing board may have depressed land areas, the continents and islands as well depressed from the top surface of the board as shown at 51 and instead of playing pieces in the form of plain discs and cards bearing the outlines of the countries, the countries will be cut out to shape, for example as shown best respectively in viewing the removed pieces 52, 53 and 54 for Portugal, Spain and France in the form of jigsaw puzzle pieces to be fitted, along with other country pieces already fitted, into the depressed continental areas as in Europe, FIG. 4, where you will find country pieces for Italy, Switzerland and West Germany already placed. The country pieces will be selected one at a time from a pile of these country pieces and will be used as the playing pieces to be advanced along the lines of spaces in lieu of the discs 36, 37, 38 that were used with the cards and a player can draw a country piece at each turn and the game played without cards or the discs, but it may be well to keep the cards for scoring purposes.

It should be understood that to play the game with puzzle country parts the game board does not have to have the land areas depressed but it will be found helpful. Thus, it is clear that in doing so there has been provided a combined pachisi and puzzle game. The player upon reaching continent countries along lines of spaces will place the puzzle piece upon the country puzzle outline of the board in the continental depression outline or areas. Outlines of the countries will be found in the depressed area as indicated at 59 as upon the undepressed map of FIGS. 1a and 1b so that the locating or fitting of the country pieces will not be difficult. The players will continue the playing process as above described until one player has fitted into place at least the majority of the countries of the game. As the game is played the name of countries so placed can be listed by pencil on a score sheet under the names of the player by whom they were placed, or completed cards can be kept in a pile and counted at the end of the game and to them additional scoring points the player may have acquired. Different points can be given to different countries. The more distant countries can be given higher points than the less distant ones.

The depressions 51 can be effected by swaging or compressing the cardboard or the body can be made up of two layers, an unpunched lower layer and a punched or cutout upper layer having the openings therein and pasted over the unpunched lower layer. The lines of spaces will be printed on the upper punched layer while the printing within the depressed continental and country designated or destination areas will be done on the lower layer. Certain coloring can be made of the different map areas and country playing pieces. The country playing pieces can be made the color of the continent or the colors as found on standard printed world map and selected by the player wanting to work in a particular continent.

In FIG. 5 there is shown a slightly further modification wherein country struck puzzle playing pieces 52' as of Portugal and of other countries as well are provided with side edge pockets as indicated at 52''. Small cards 61 are provided which can be slipped into the pockets of the country playing puzzle pieces and on these cards are the names of the raw materials and products for which a particular country has become noted or famous. The player when he has reached the home space for his country piece may be given an extra point if before pulling the card he can name the raw materials or principal products for which the country is famous.

The name of the capital for the country could be left off the map, cards and country playing pieces and put on card 61 so that the player would be required to name them for extra points before pulling card 61 from the pocket in the country playing piece. Different sets of cards 61 can be substituted for the different data wanting to be taught. As a matter of fact, this data could be printed upon the backs of the large selective directive cards shown in FIG. 2 or country outline jigsaw puzzle playing pieces and kept obscured until the playing piece has been parchisied to its destination. All of this can give extra points to the player and as mentioned it should be apparent that the game can be played and scored in various ways as may be dictated by the players themselves but generally the game can be played with much interest and with structural playing parts and manner of playing the game that have been set forth. Certain of the large country areas can be represented by more than one puzzle part so the puzzle part would not be hindered in its use as a playing piece.

It should now be apparent that there has been provided an educational geographical map board game by which a player can be taught the location of the countries of the world, their capital cities and their principal raw materials or products. There has been provided a geographical map game in which jigsaw puzzle pieces can be used as the discs are in pachisi fashion along the lines of spaces in accordance with the throw of dice and which when reaching the terminal end of the lines of spaces and country areas of the map will be assembled in puzzle fashion to overlie a continental area of the map. In other words, a jigsaw puzzle has been incorporated in a pachisi game that requires the assemblage of its parts to complete the game. Also there has been provided a game board that has a closed line of playing spaces extending peripherally thereof with a starting point therein and a plurality of lines of spaces that extend inwardly therefrom, certain of which have branch lines, cross or intersect other lines and terminate at various continental locations on the game board. Such an arrangement of lines of spaces can be used with game boards not portraying a map area but other subjects and preferably meaningful ones and similarly arranged upon a game board as are the continents and countries of the present game.

While various changes may be made in the detail construction and in the playing of the game, it shall be understood that such changes shall be within the spirit and scope of this invention as defined by the appended claims.

What is claimed is:

1. In an educational world map game, a game board displaying a world map with the several continental outlines thereon, each of the continental outlines having the various country areas outlined and designated therein, a line of pachisi-like playing spaces extending about the periphery of the game board, a plurality of lines of pachisi-like playing spaces respectively extending inwardly at different points along said peripheral line and terminating respectively at the respective continental outlines and at a country area outlined therein, certain of said inwardly-extending lines of spaces having branch lines of spaces and intersecting one another, thereby extending the certain inwardly-extending lines of spaces to more than one continental outline, playing pieces adapted to be advanced along the pachisi-like playing spaces from a starting point in at least one of the lines of playing spaces in response to numbers as appearing from a set of dice thrown in turn by the players of the game and toward selective designated country areas of a continent and a plurality of jigsaw puzzle parts corresponding in number to at least the respective number of country areas of all the continental outlines and adapted to be fitted over the country areas when the playing pieces have arrived at the country area terminals and in jigsaw puzzle fashion with one another to finally fill up the continental outlines of the world map to conclude the game.

2. In an educational world map game as defined in claim 1 and said puzzle pieces of the countries being adapted to serve as playing pieces and when selected used to be moved along the pachisi-like playing spaces to the country designated by their shape.

3. In an educational world map game as defined in claim 1 and a set of country selecting cards to determine the country to which the playing pieces are to be moved, said selecting cards corresponding in number at least to the number of the country areas of all of the continental outlines, each of the cards portraying the outline of the selected country and giving other data pertinent thereto.

4. In an educational world map game as defined in claim 1 and said continental outlines being depressed into the surface of the game board to confine the country-shaped jigsaw puzzle pieces therein.

5. In an educational world map game as defined in claim 1, certain of said country-shaped jigsaw puzzle pieces having side pockets therein, and cards bearing data pertinent to the country represented by the puzzle piece adapted to be respectively slidably fitted into the side pockets of the puzzle pieces.

* * * * *